US005186302A

United States Patent [19]

Johnson et al.

[11] Patent Number: 5,186,302

[45] Date of Patent: Feb. 16, 1993

[54] ESCALATOR SKIRT AND DECK PANEL INSTALLATION

[75] Inventors: Gerald E. Johnson, Farmington, Conn.; Arthur McClement, Bloomington, Ind.; James A. Rivera, Bristol, Conn.

[73] Assignee: Otis Elevator Company, Farmington, Conn.

[21] Appl. No.: 866,736

[22] Filed: Apr. 10, 1992

[51] Int. Cl.[5] ..... B66B 23/22

[52] U.S. Cl. ..... 198/335

[58] Field of Search ..... 198/335, 337, 338

[56] References Cited

U.S. PATENT DOCUMENTS

| | | | |
|---|---|---|---|
| 3,991,877 | 11/1976 | Kraft et al. | 198/335 |
| 4,159,758 | 7/1979 | Courson | 198/335 |
| 4,646,907 | 3/1987 | Streibig et al. | 198/335 |
| 4,819,781 | 4/1989 | Saito et al. | 198/335 |
| 4,842,122 | 6/1989 | Van Nort | 198/335 |
| 5,029,690 | 7/1991 | Nguyen et al. | 198/335 |

FOREIGN PATENT DOCUMENTS 2941773 4/1981 Fed. Rep. of Germany ..... 198/335

*Primary Examiner*—D. Glenn Dayoan

*Attorney, Agent, or Firm*—William W. Jones

[57] ABSTRACT

The step skirts and inner deck panels are fixed against outward deflection by a series of spacer pins which abut the balustrade mounting assembly beneath the deck panels, and which are secured to the skirt and deck panels. When the escalator is erected, the skirt and deck panels will be set relative to the sides of the steps so as to obtain the appropriate gap between the steps and the skirts. An overlapping portion of the deck and skirt panels is formed with an aperture, and a guide sleeve is fixed to the inner surface of the skirt panels in registry with the aperture. A pin is then pushed through the aperture and sleeve until it comes in contact with the balustrade mount assembly. The pin is then secured to the deck and skirts, and prevents deflection of the deck and skirts toward the balustrade mount assembly.

5 Claims, 1 Drawing Sheet

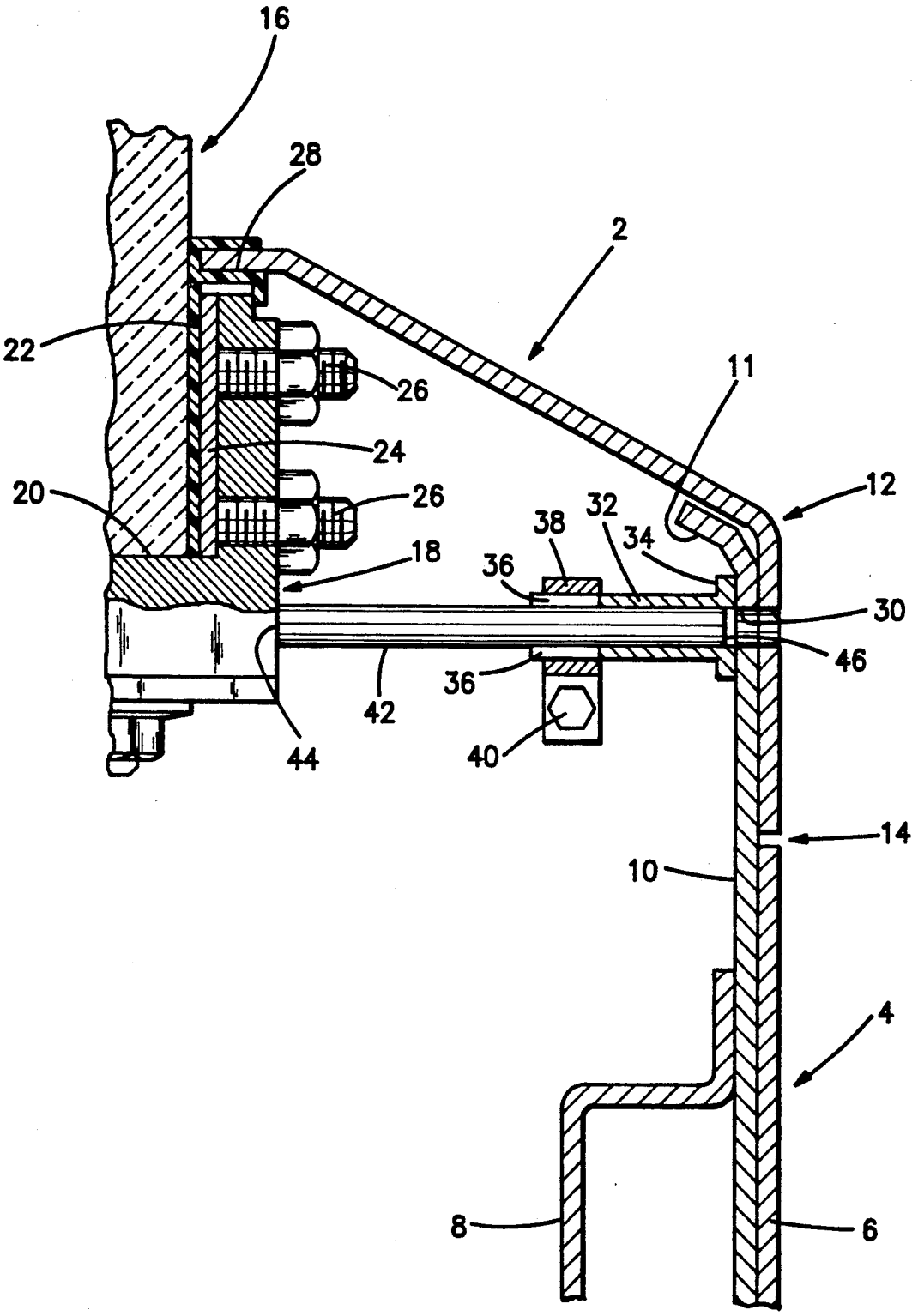
16
28
2
22
26
11
24
12
20
26
38
32
34
18
36
30
46
36
42
40
44
14
10
4
8
6

ESCALATOR SKIRT AND DECK PANEL INSTALLATION

TECHNICAL FIELD

This invention relates to an inner deck and step skirt installation for an escalator or a moving walkway. More particularly, this invention relates to an installation of the character described which establishes and maintains against deflection, the proper spacing of the deck and skirt panels relative to the escalator steps.

BACKGROUND ART

Modern escalators and moving walkways are constructed on trusses which support all of the components of the conveyors. In most cases with such escalators and the like which have glass balustrades, the balustrade mounts, which are generally clamps mounted on the truss, provide the locus for properly positioning the other components of the escalator, such as the decks, skirts, steps, handrail guides, and the like. Typically, the skirts and decks will be located relative to the balustrade mounts by means of brackets, spacers, or other means which are fixed to the balustrade mounts, and which may also be fixed to the skirts and/or decks, or merely abut the latter. In these types of escalators, the skirt panels are the vertical panels which directly flank the steps, and the deck panels are the panels which extend from the balustrades toward and which overlap the skirt panels. Care must be taken to ensure that both the deck and skirt panels are properly positioned relative to the steps, and that the desired positioning is maintained. Since these panels are sheet metal, they can be deflected away from the steps, and such deflection must be prevented.

U.S. Pat. No. 3,991,877 granted Nov. 16, 1976 to J. K. Kraft, et al; U.S. Pat. No. 4,159,758 granted Jul. 3, 1979 to I. C. Courson; U.S. Pat. No. 4,646,907 granted Mar. 3, 1987 to K. Streibig, et al; and U.S. Pat. No. 4,842,122 granted Jun. 27, 1989 to A. D. Van Nort are illustrative of typical deck and skirt mounting installations for escalators and moving walkways of the types which include glass balustrades. It will be noted that these assemblies all include brackets which are fixed to the balustrade mounts, and which engage the inner surface of the deck panels to properly position them relative to the steps. These inner brackets must be properly aligned before the deck is put in place, or else repeated corrective action must be taken until the decks are properly positioned. Also, when the deck panels are removed, the spacer brackets remain behind on the balustrade mounts, and present obstructions for servicing of the interior of the deck areas. These brackets limit tool accessibility and can cause hand injuries to escalator mechanics and service men. The brackets themselves will not be removed from the balustrade mounts except in rare cases, because to do so requires repeating the alignment process over again so that the decks can be properly replaced.

The U.S. Pat. No. 4,842,122 to Van Nort discloses a deck spacer which is as described above, and it also discloses a skirt spacer which is positioned just above the treads of the steps, and which is accessible from the step side of the skirts. The spacer allows one to set and adjust the position of the skirts, and thus the gap between the skirts and steps from the step side of the escalator after the skirts have been positioned on the truss. The spacer includes an internally threaded cylindrical piece which is welded to the internal skirt bracket; and a set screw which is threaded into the cylindrical piece, and which carries a washer that engages the inner surface of the skirts, i.e., the surface of the skirts which faces away from the steps. The set screws are accessible through openings in the skirts so that an Allen wrench or the like can be used to turn the set screw so as to move the washer toward or away from the steps. This will cause movement of the skirt toward or away from the steps so that an appropriate skirt-step gap can be established. So long as the washer maintains its position, and the set screw does not thereafter turn, the preferred gap will be maintained.

This skirt adjustment system is an improvement over the prior art systems which could not be accessed from the outside of the escalator, but it still has its shortcomings. This system still must be set up with the step skirts off of the escalator, it still is fixed to the interior brackets on the escalator, and it requires that the set screws and the skirt openings remain in alignment, or else it can't be used. This need for relatively perfect alignment means that the positioning of the cylinders, which are welded to the brackets must be very accurately accomplished so as to match the spacing between adjacent openings in the skirts. Another shortcoming of the Van Nort structure is that it does not provide any solution to the problem of properly positioning the deck panels, which still use the bulky fixed internal brackets.

DISCLOSURE OF THE INVENTION

This invention is directed to an escalator deck and/or skirt installation assembly that can be used to establish proper initial positioning of the decks and/or skirts; that will be operable to maintain such proper positioning against deflection during operation of the escalator; and that does not remain behind on the supporting structure when the decks and skirts are disconnected and removed therefrom. The following description depicts an embodiment of the invention which is used to establish and maintain the position of the deck and the upper end of the skirt on an escalator; however, a similar arrangement could also be used to position the lower portion of the skirt which faces the steps.

Adjacent edges of the skirt and the deck overlap along the full length of the escalator. Spaced apart openings are formed through the overlap which are sized to be able to pass the blade of a Phillips screwdriver, or a similarly sized implement. A sleeve with a basal flange is welded to the interior of the skirt panel in registry with each of the spaced apart openings. The sleeve will have a flexible side wall which may be created by longitudinal slots formed in the side wall, for example. A clamp is disposed about the sleeve so as to be capable of applying a radial clamping force to the sleeve. The openings and sleeves will be positioned so as to be opposite to the balustrade supporting channel member of the escalator. Cylindrical pins are provided for insertion into the openings and sleeves from the step side of the skirts and decks. The pins are long enough to reach and contact the side of the balustrade supporting channel when pushed completely into the sleeves and past the openings. The deck and skirt panels will be preliminarily positioned next to the steps with the free edge of the deck panel being nested in an elastomeric liner strip which is disposed between the balustrade and the balustrade support channel. The deck and skirt panels are then properly positioned on the escalator by inserting the pins into the sleeves through the openings, and by using a Phillips screwdriver or the like to manipulate the pins until they act as spacers against the balustrade support channel to establish the proper position of the deck and the upper edge of the skirt. The deck and skirt panels are then removed from the liner, and the clamps on the sleeves are tightened to fix the positions of the pins in the sleeves. When the deck and skirt panels are replaced, they will automatically return to their adjusted positions by reason of the fixed pins engaging the balustrade support channel. The fixed pins will also resist deflection of the decks and skirts by forces imposed on them from the step side of the escalator. It will be appreciated that whenever the decks and skirts are thereafter removed for service or repair, the spacer pins will come with them and there will be no activity-constraining or constricting brackets or any other substructure which will impede a mechanic in the performance of his duties.

It is therefore an object of this invention to provide an improved escalator deck and skirt installation assembly which establishes and maintains proper positioning of the decks and skirts relative to the steps.

It is a further object of this invention to provide a deck and skirt installation assembly of the character described which can be properly aligned from the step side of the escalator.

It is an additional object of this invention to provide a deck and skirt installation assembly of the character described which includes spacer components that are permanently secured to the deck and skirt panels.

These and other objects and advantages of the invention will become more readily apparent from the following detailed description of a preferred embodiment thereof, when taken in conjunction with the accompanying drawing which is a fragmented sectional view of the deck-skirt overlap zone and the balustrade support channel.

BEST MODE FOR CARRYING OUT THE INVENTION

Referring to the drawing, the escalator deck panel is denoted generally by the numeral 2, and the skirt panel assembly by the numeral 4. It will be noted that the skirt panel assembly is made up of three panel components, an outer panel 6 facing the passenger area of the escalator, an inner panel 8, and a medial panel 10 sandwiched between the panels 6 and 8. The medial panel 10 and the deck panel 2 overlap each other at the corner 12, and the deck panel 2 abuts the outer panel 6 at the joint 14.

The glass balustrade 16 is mounted in a support channel 18 in a slot 20 therein. An elastomeric liner 22 is positioned in the slot 20 adjacent to the balustrade 16. A clamp plate 24 is forced against the liner 22 by set screws 26 whereby the balustrade 16 is locked in place in the support channel 18. The upper end of the liner 22 is formed with an inwardly open pocket 26 into which the outer edge of the deck panel 2 nests.

An opening 30 is formed in the vertical part of the deck-skirt overlap, and a sleeve 32 having a basal flange 34 is positioned on the inside of the medial panel 10 in registry with the opening 30. The sleeve 32 may be fixed to the panel 10 by welding the flange 34 and panel 10 together. The end of the sleeve 32 which faces the support channel 18 is preferably rendered flexible by longitudinal slots 36, and a locking collar in the form of a ring clamp 38 with an adjustment screw 40 is mounted on the exterior of the flexible portion of the sleeve 32. To properly position the deck 2 and skirt 4, the upper edge of the deck 2 is inserted into the liner pocket 28 and the space between the corner 12 and the support channel 18 is established using the escalator steps as a reference. Once the position is properly established, pins 42 are pushed through the openings 30 and the sleeves 32 until their outer ends 44 abut the support channel 18. The length of the pins 42 is such that with proper positioning, the inner ends 46 will be recessed inside of the sleeves 32. Once the pins 42 are properly in place, friction between the pins 42 and sleeves 32 will prevent premature movement of the pins 42. It will be appreciated that the pins 42 may be preliminarily positioned in the sleeves at the factory prior to shipment to the site, whereupon they will be finally adjusted. The deck 2 and skirt 4 assembly is then removed from the liner pocket 28 to expose the clamps 38 whereupon the latter are tightened onto the sleeves 32 and pins 42 to lock the two together. When the deck 2 and skirt 4 assembly is again mounted in the liner pocket 28, the proper spacing will automatically be reestablished. Whenever the deck 2 and skirt 4 assembly must be removed for servicing or repair of the escalator, the pins 42 come away with the assembly 2, 4 thereby leaving no substructural obstructions behind to impede the mechanics in the performance of their tasks.

It will be readily appreciated that the deck and skirt installation assembly of this invention can be easily erected and properly positioned on the escalator without the need of special tools, and from the step side of the escalator. When the deck and skirt panels are removed from the remainder of the escalator for servicing and/or repair, no impediments from the installation are left behind to hinder the mechanics.

Since many changes and variations of the disclosed embodiment of the invention may be made without departing from the inventive concept, it is not intended to limit the invention otherwise than as required by the appended claims.

What is claimed is:

1. An inner deck and balustrade mounting assembly for an escalator or moving walkway, said assembly comprising:

a) clamp means for supporting said balustrade, said clamp means comprising an elastomeric liner disposed adjacent to said balustrade;

b) an inner deck panel connected to said liner, said deck panel including a first portion extending downwardly and inwardly toward a passenger conveying area of the escalator or moving walkway, and a second vertically depending portion extending downwardly from an inner end of said first portion;

c) tubular sleeve means disposed between said second portion of said deck panel and said clamp means, said sleeve means having a through bore;

d) an opening in said second portion of said deck panel, said opening aligning with said sleeve means through bore;

e) pin means telescopingly received in said sleeve means through said bore, said pin means extending toward and abutting said clamp means and said pin means being free of securement to said clamp means; and f) means for locking said pin means against axial movement relative to said sleeve means whereby said deck panel is prevented from moving toward said clamp means.

2. The mounting assembly of claim 1 wherein said sleeve means through bore is smooth walled; and said pin means is smooth walled.

3. The mounting assembly of claim 1 wherein said sleeve means has a plurality of longitudinal slots therein for radial flexibility and said means for locking comprises a locking collar disposed over said slots and selectively tightenable thereon.

4. The mounting assembly of claim 3 further comprising skirt panel means disposed in lapping relationship with said second portion of said deck panel, said skirt panel means including an opening therethrough which is coaxial with said deck panel opening whereby said pin means can be telescoped through said sleeve means via said skirt and deck panel openings.

5. A method for positioning an escalator or moving walkway inner deck panel relative to a balustrade mount assembly, said method comprising the steps of:

a) providing an opening in said deck panel opposite said mount assembly;

b) inserting a pin through said opening and advancing said pin toward said mount assembly until said pin engages said mount assembly, said pin remaining free of securement with said mount assembly; and c) securing said pin to said deck panel.

* * * * *